US006155216A

United States Patent [19]

Riley

[11] Patent Number: 6,155,216

[45] Date of Patent: Dec. 5, 2000

[54] VARIABLE VALVE APPARATUS

[76] Inventor: Michael B Riley, 1115 Lindenwood Dr., Fort Collins, Colo. 80524

[21] Appl. No.: 09/012,958

[22] Filed: Jan. 26, 1998

[51] Int. Cl.[7] ..... F01L 1/34

[52] U.S. Cl. ..... 123/90.15; 123/90.48

[58] Field of Search ..... 123/90.15, 90.16, 123/90.22, 90.23, 90.48, 90.5

[56] References Cited

U.S. PATENT DOCUMENTS

| | | | |
|---|---|---|---|
| 4,414,935 | 11/1983 | Curtis et al. | 123/90.16 |
| 4,868,215 | 9/1989 | Parsons | 123/90.16 |
| 5,002,022 | 3/1991 | Perr | 123/90.16 |
| 5,099,805 | 3/1992 | Ingalls | 123/90.16 |
| 5,111,781 | 5/1992 | Kaku et al. | 123/90.16 |
| 5,598,814 | 2/1997 | Schroeder et al. | 123/90.15 |

*Primary Examiner*—Weilun Lo
*Attorney, Agent, or Firm*—Gibson, Dunn & Crutcher LLP

[57] ABSTRACT

A rotatable eccentric sleeve allows the position of a cam follower in an internal combustion engine to be altered such that the timing of opening and closing of valve events is altered controllably. Intake and exhaust valves may be phased differently within a compact mechanism.

14 Claims, 12 Drawing Sheets

VARIABLE VALVE APPARATUS

FIELD OF THE INVENTION

The present invention relates to an internal combustion engine using poppet type valves to direct gases into and out of one or more cylinders. The phasing of the valves in an engine that utilizes a roller lifter between the cam and the pushrod or rocker arm may be varied continuously and independently if required, to optimize engine torque at different engine speeds, as well as to improve idle stability, emissions and fuel efficiency.

BACKGROUND OF THE INVENTION

A description of the benefits of variable valve actuation is given in U.S. Pat. No. 5,456,224 by Riley. Optimal operation of valves requires suitable variation of lift, duration and phase. Many of the benefits desired can be achieved by suitable variation in phase alone.

Variation of phase has been accomplished in a number of different ways. One of the simplest methods to comprehend is to alter the phase between the crankshaft and the intake camshaft in a dual overhead camshaft layout. This may occur with a drive mechanism that incorporates splines on the camshaft and a driving drum, as shown in SAE paper 901727. During operation the driving drum and camshaft are moved relative to each other while the cam drive undergoes normal operation.

Examples of phase shift using axial, three-dimensional cams, and cam switching are described in U.S. Pat. No. 3,618,574 by Miller, and U.S. Pat. No. 4,970,997 by Inoue et al.

Phase shifting for internal combustion engines where the valves are actuated via pushrods is more limited. Pushrod engines generally use one camshaft only. Cam phasers based on changing the angular relationship between the crankshaft and camshaft, as described in SAE paper 901727, cause identical change in the timing of all valve events, both intake and exhaust.

Phase shifting based on the Clemson camshaft described in U.S. Pat. No. 4,770,060 allows variation of selected lobes on the camshaft, while retaining the normal drive mechanism. Independent phasing of intake and exhaust can be achieved by incorporating cam drive phasing as well.

Another approach is shown in U.S. Pat. No. 2,266,077 by Roan. As part of his variable valve mechanism, Roan interposed a movable roller between the camshaft and the follower under the control of a lever to the side. Movement of the lever resulted in a change of the phase of the valve events relative to the crankshaft. A similar approach is taken by Smith in U.S. Pat. No. 2,851,851.

SUMMARY OF THE INVENTION

The present invention describes a simple system for dynamically altering the phasing of each valve in an engine that incorporates a roller lifter between the cam and the pushrod or rocker arm. In most cases, all intake valves would be ganged together, and all exhaust valves would be ganged together, or alternatively, all valves may be phased together. It is also easily practical to have valve timing of each cylinder adjusted independently to allow optimization.

Variation of phase may be achieved using an eccentric sleeve surrounding the roller follower. (It should be appreciated that the roller follower need not actually be a roller; any curved surface will suffice. Therefore, the term "roller follower" as used herein is deemed to mean a roller or other curved surface.) Controlled rotation of the sleeve causes the follower to traverse in an arcuate path, resulting in movement across the camshaft lobe perpendicular to the axis of the camshaft, as well as movement parallel to the axis of the camshaft. This offsetting of the roller follower results in changing angles at which valve operation commences and ceases. Alignment techniques for the roller followers to maintain their axes parallel to that of the camshaft are similar to systems already being used. Actuation systems for the rotation of the eccentric sleeve include, but are not limited to, longitudinal movement of one or more rods attached to off-center pins extending from the eccentric sleeves, longitudinal movement of a toothed rack with teeth formed into the exterior of the sleeves, and a rotatable worm gear on a longitudinal shaft, with gear teeth formed on the exterior of the sleeve.

The body of the roller follower may be reduced in diameter to allow fitment of the sleeve in current production engine lifter bores. The diameter of the roller may be the same as the stock follower being replaced, or even smaller if design allows. The top of the follower, which receives the pushrod or rocker arm, may be a separate but attachable piece that is secured onto the lower part of the follower, allowing a larger diameter for the lifter both above and below the eccentric sleeve while giving a suitably small diameter within the sleeve.

The overall phase change may be doubled over conventional half-speed cam drives by driving the camshaft at one quarter the speed of the crankshaft. Such a camshaft would require two lobes per cam to actuate each valve.

DETAILED DESCRIPTION OF THE INVENTION

Figure 1:
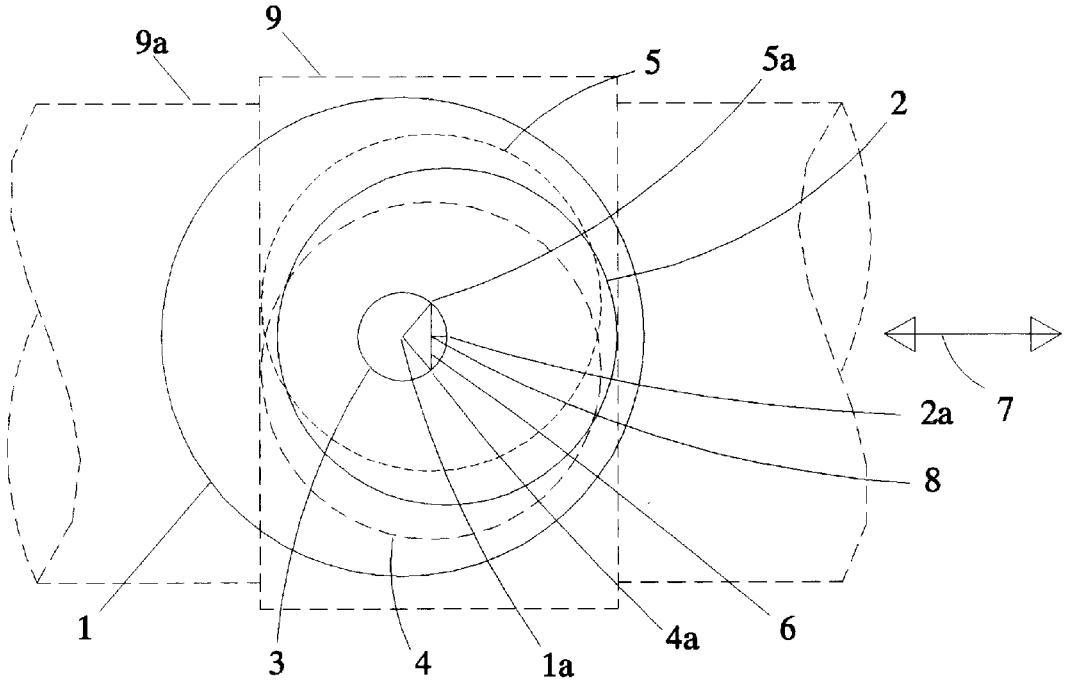
FIG. 1 shows how the geometry of rotation of the eccentric sleeve achieves transverse travel of the roller follower on the camshaft. This view is from the top of the roller follower.

The geometry of the eccentric sleeve is shown in FIG. 1, which is a view along the axis of the follower. Circle 1 is the outside edge of the eccentric sleeve, with center 1*a*, and circle 2 is the inside edge of the eccentric, with center 2*a*, offset from the center of the sleeve. Circle 3 represents the path of the center of the offset as the sleeve is rotated. Circle 4, center 4*a*, shows the position of the offset when the sleeve is rotated by some angle, here 50° clockwise, around 1*a*. Similarly, circle 5, center 5*a*, shows the position of the offset when rotated the same amount in the opposite direction around 1*a*. Line 6, between the centers of circles 4 and 5, shows the distance that the center of the roller moves transverse to the axis of the camshaft, shown as arrow 7. Line 8, perpendicular to line 6 is the farthermost distance to circle 3. This represents the maximum fore-aft movement of the follower along the axial direction of the camshaft, parallel to arrow 7. The outline of the cam shaft 9*a* and the base circle of the cam 9 are also shown.

Figure 2:
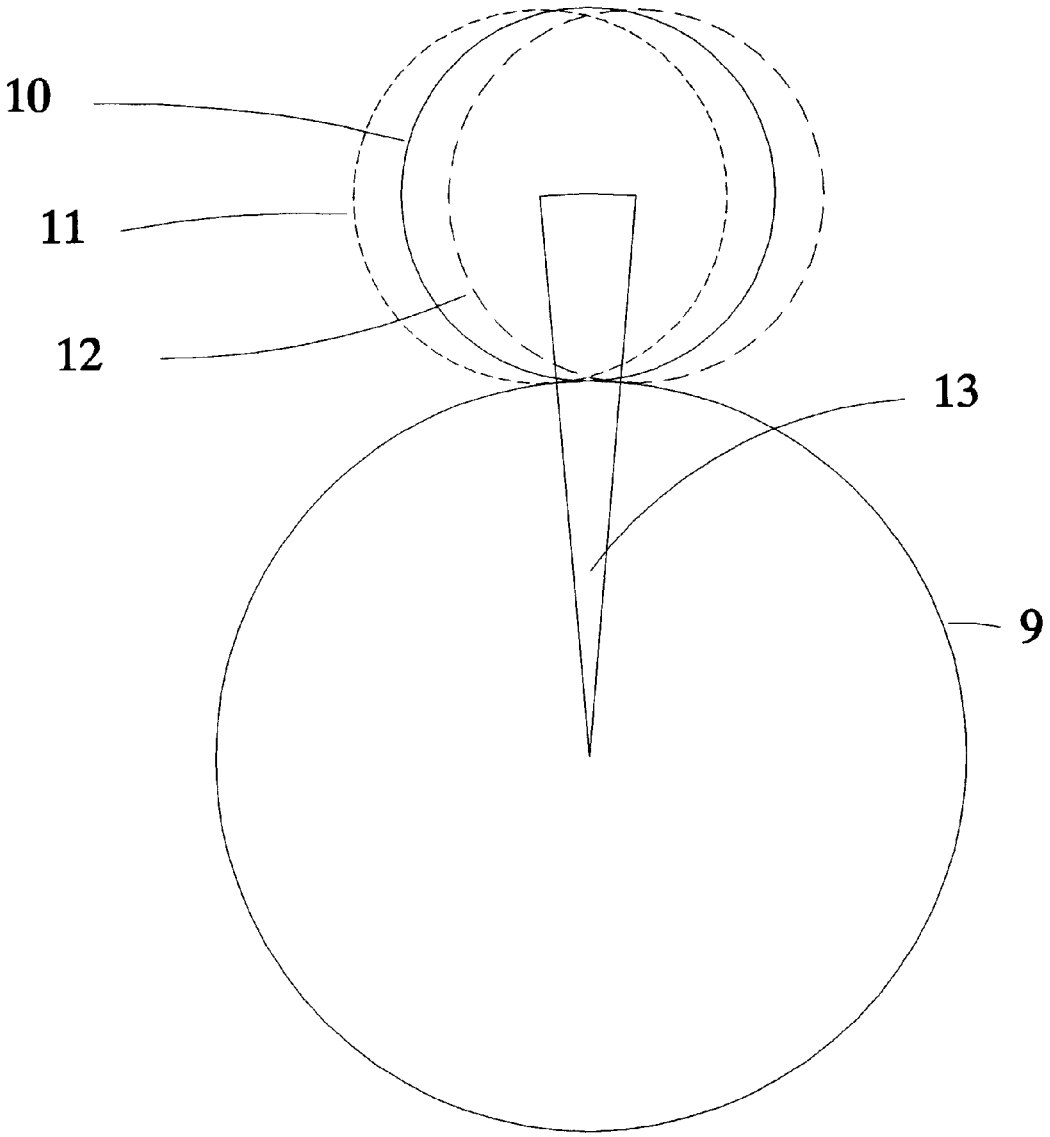
FIG. 2 shows the resultant angular movement of the roller on the camshaft. This view is looking down the axis of the camshaft.

FIG. 2 shows a view parallel to the axis of the camshaft. Circle 9 represents the base circle of the cam. Circle 10 represents the roller follower in the central position, where the follower would move in a direct line between the centers of the cam base circle and the roller. Circles 11 and 12 show the roller translated to positions correlating to the positions of the eccentrics 4 and 5. Angle 13 is the camshaft angle through which the follower translates. The phasing at the crankshaft is double that for the camshaft for four-stroke engines with conventional half-speed cam drives.

Figure 3:
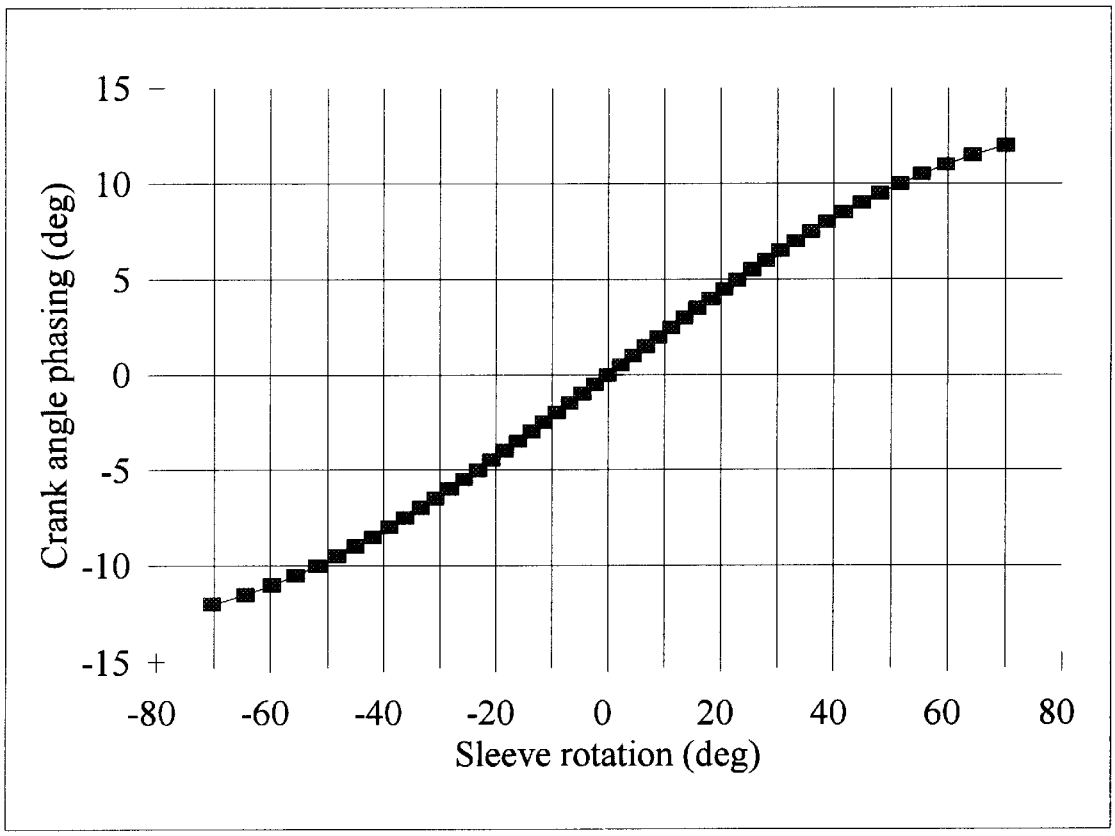
FIG. 3 shows a plot of the relationship between sleeve rotation and the change in phasing of the valve event with respect to the crankshaft.

FIG. 3 shows how rotation of the eccentric results in changed phase of the roller, in crankshaft angle.

Figure 4:
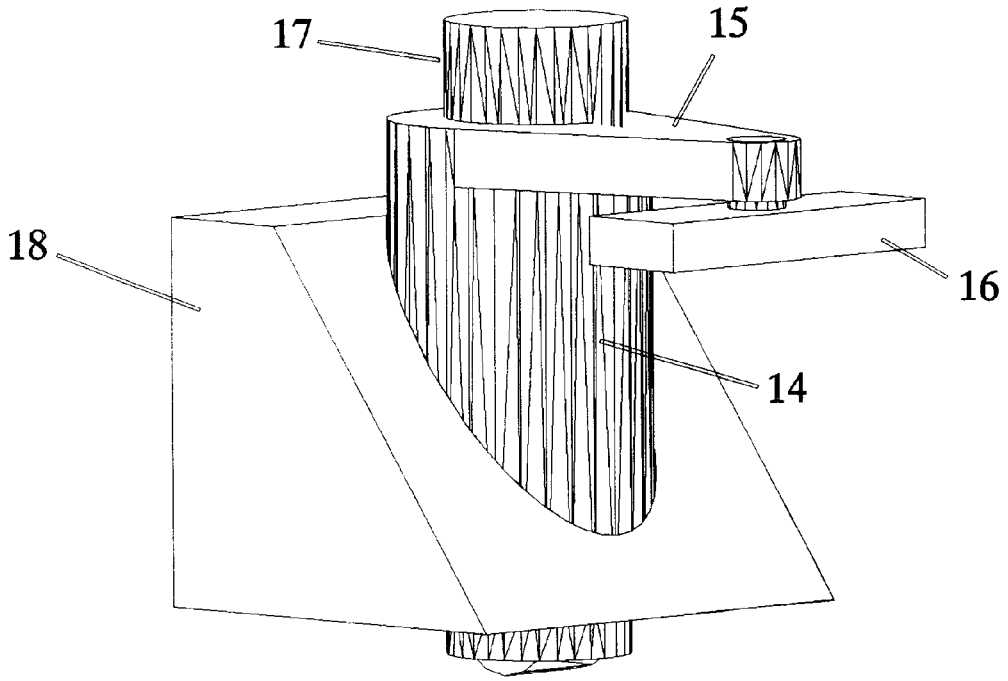
FIG. 4 shows a schematic assembly of an eccentric sleeve with a tang for attachment of a rod to move the sleeve, with a roller follower inside the sleeve. The sleeve and follower are shown housed in a cutaway portion of an engine block. The rod moves in an arcuate path.

FIG. 4 shows one embodiment of an eccentric sleeve 14 with a tang 15 for attachment of a rod 16, to rotate said sleeve, in which is shown a roller follower 17. The rod 16 is moved fore and aft in an arc whose radius is the distance from the center of the pin attaching tang 15 and rod 16, to the center of sleeve 14, to rotate said sleeve. Sleeve 14 and follower 17 are housed in block 18, which is shown in a cutaway section.

Figure 5:
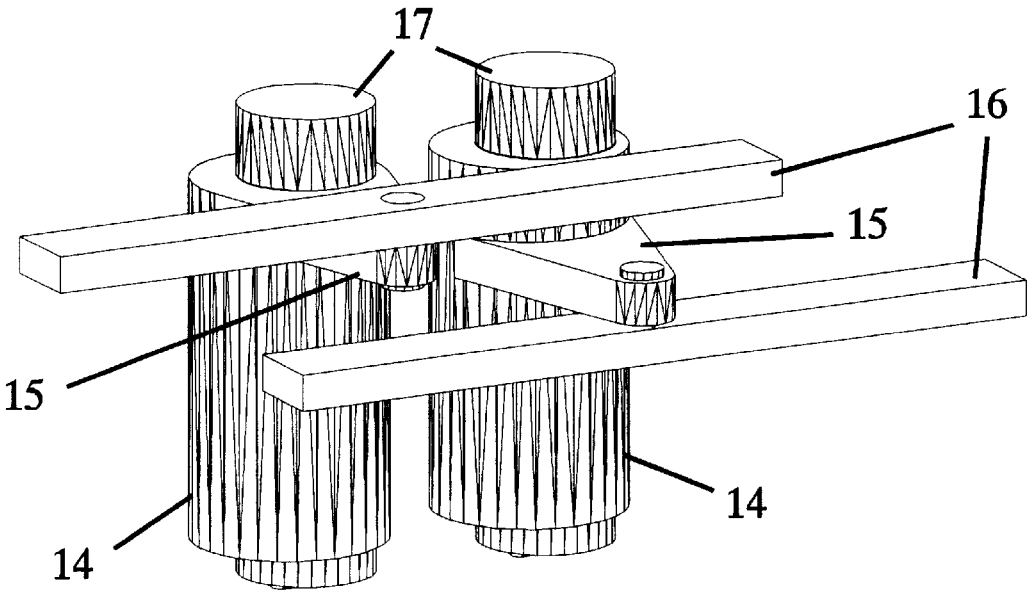
FIG. 5 shows a schematic assembly of two eccentric sleeves being actuated independently via the same mechanism as in FIG. 4.

FIG. 5 shows two sleeves 14 each actuated by independent rods 16. Each rod 16 may move fore or aft independently to achieve independent rotation of said sleeves, and thus independent phase change of each follower 17.

Figure 6:
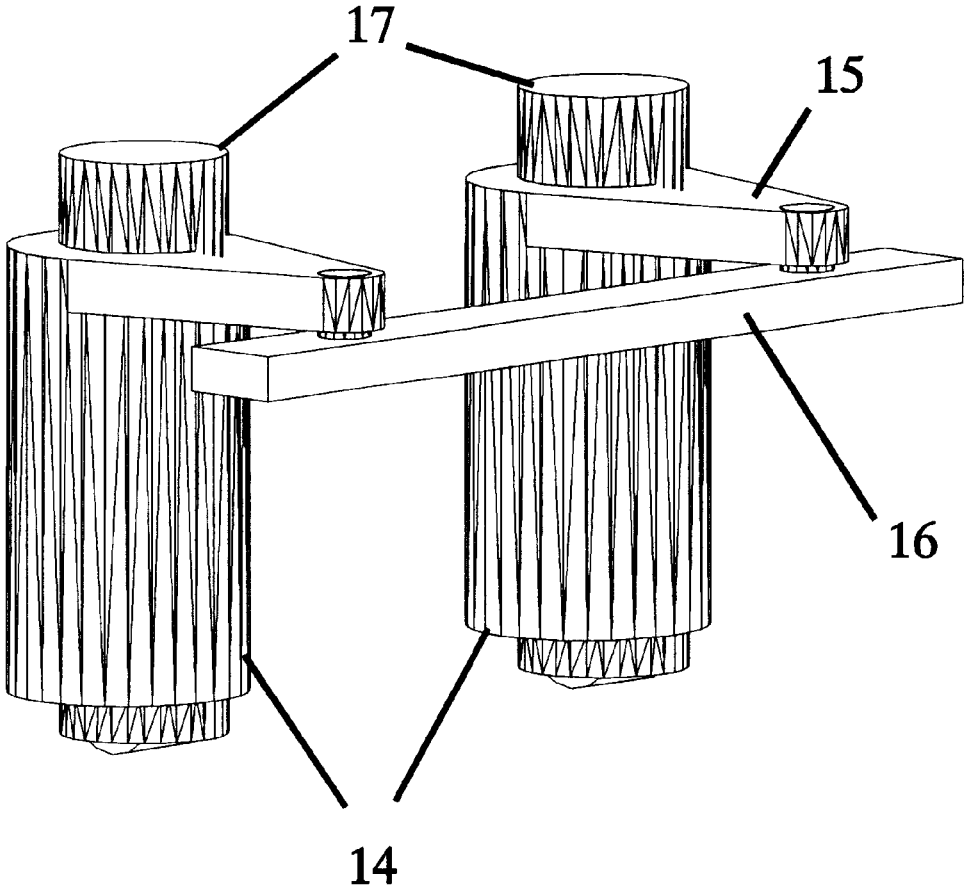
FIG. 6 shows a schematic of two eccentric sleeves ganged together for phasing via movement of a longitudinal rod.

FIG. 6 shows two sleeves 14 joined by tangs 15 to a common actuating rod 16. The path of movement of rod 16 is the same as that described in FIG. 4 above.

Figure 7:
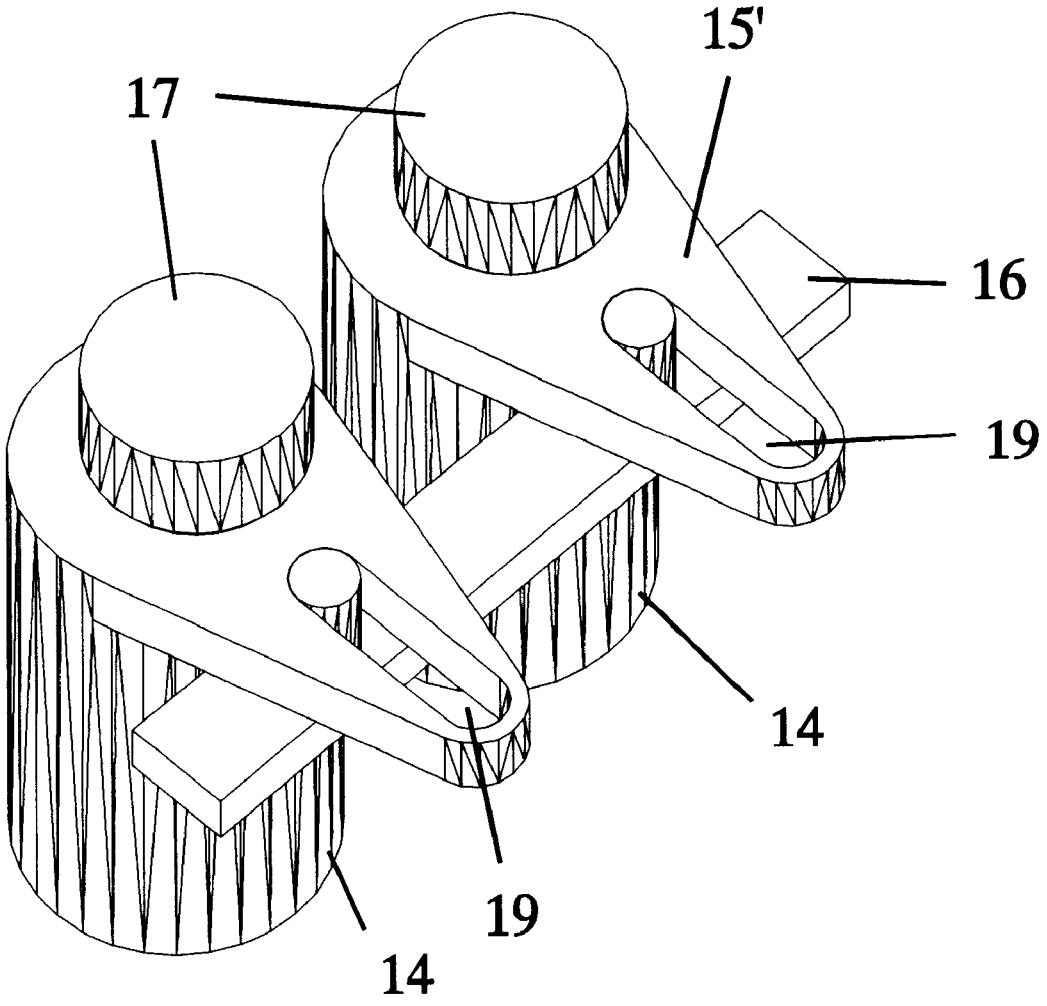
FIG. 7 shows a slotted arm attached to the eccentric sleeves to allow the actuating rod to traverse longitudinally only.

FIG. 7 shows a tang 15 on sleeve 14, but with an elongated slot 19. The purpose of said slot is to allow fore-aft movement of actuating rod 16 while maintaining a constant lateral position.

Figure 8:
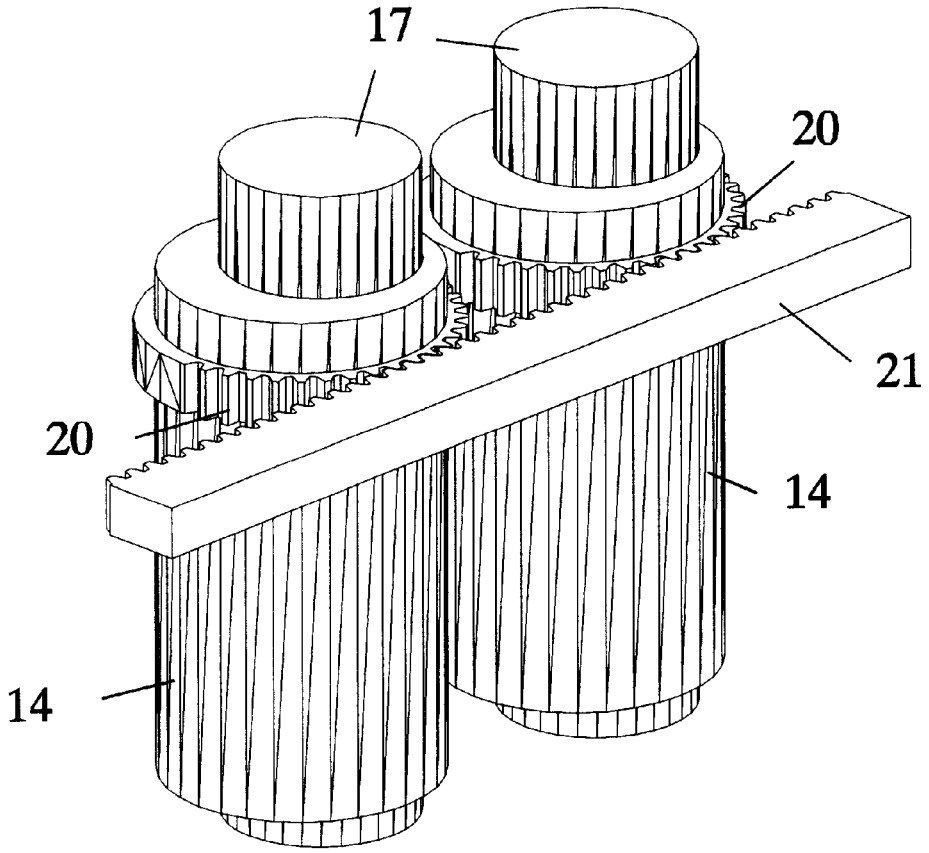
FIG. 8 shows a schematic of two eccentrics ganged together with a rack and pinion assembly for phasing via movement of a longitudinal rod.

FIG. 8 shows two sleeves 14 with gear teeth 20 incorporated around the outside. Toothed rack 21 moves fore and aft to rotate sleeves 14.

Figure 9:
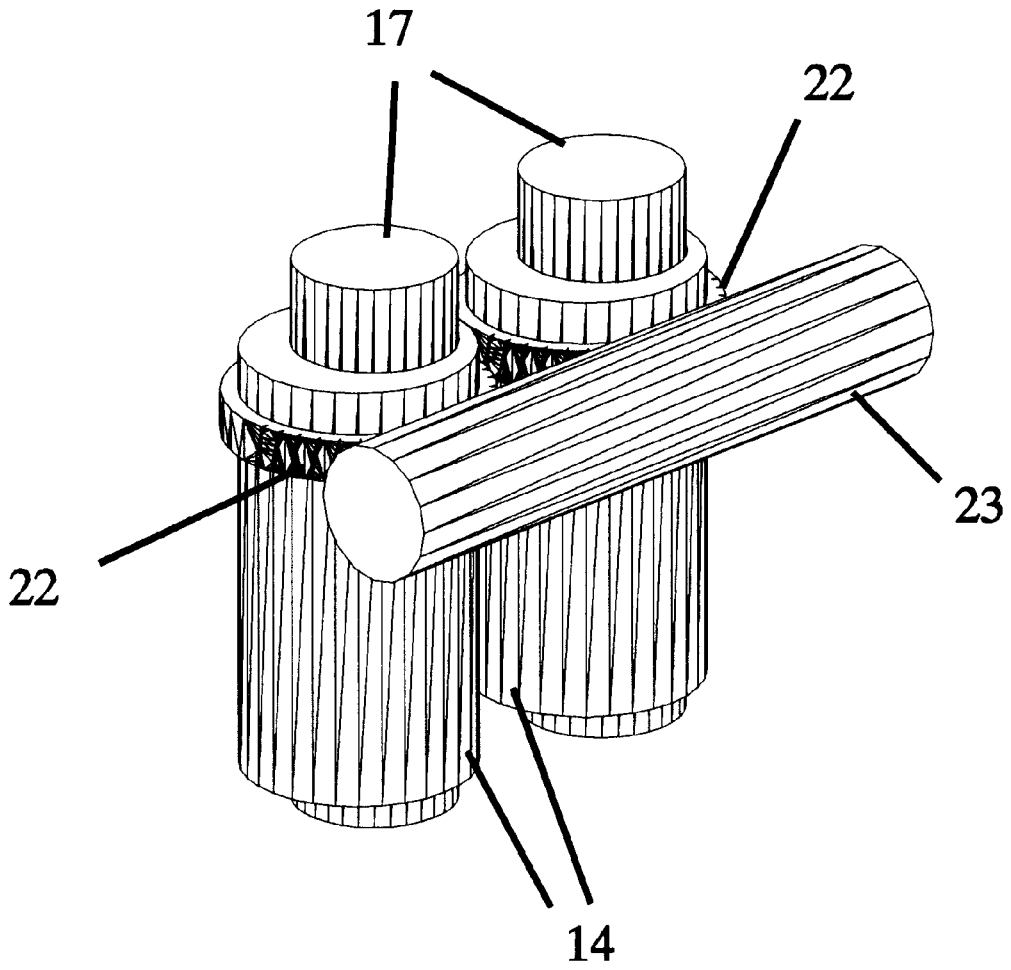
FIG. 9 shows a schematic of two eccentrics ganged together with a rotatable worm drive with worm gear teeth formed into the exterior of each eccentric.

FIG. 9 shows two sleeves 14 with worm gear teeth 22 incorporated around the outside of said sleeves. Worm drive 23 rotates to achieve suitable rotation of said sleeves.

Figure 10:
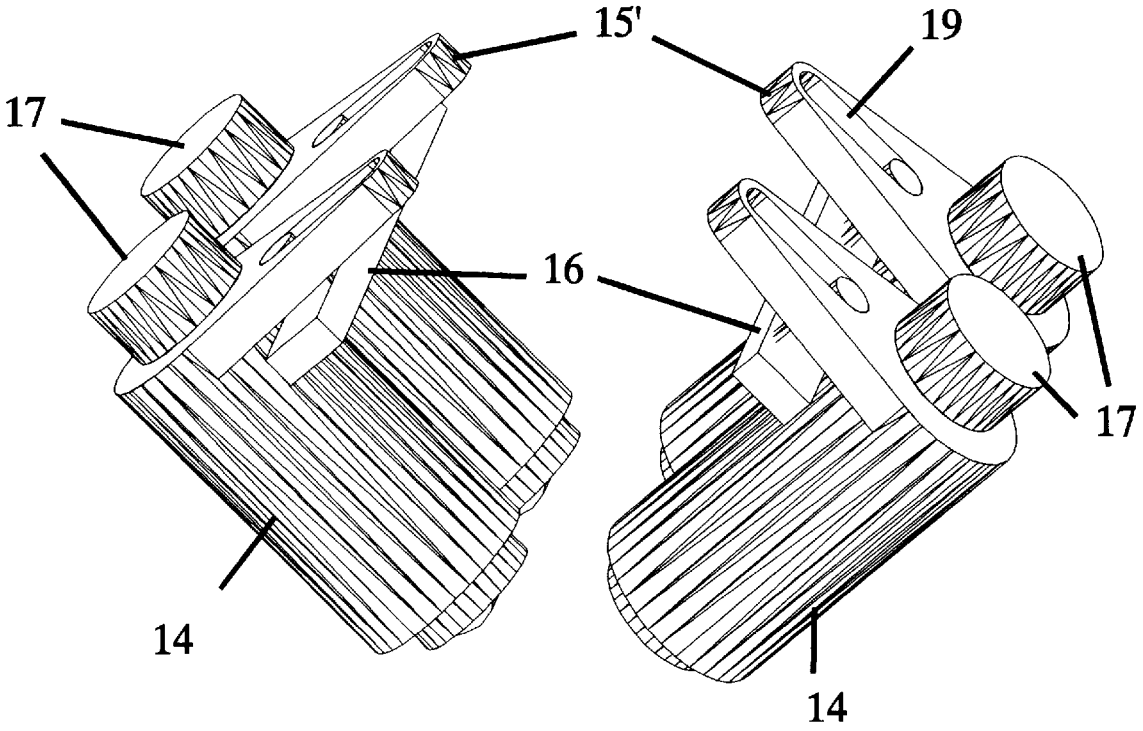
FIG. 10 shows ganging of two eccentrics in each of two banks of a V-configuration engine.

FIG. 10 shows four sleeves 14 arranged in a V formation as would occur in some engine geometries. Actuating rods 16 may be independently actuated, or mechanically linked to require only one actuator driver.

Figure 11:
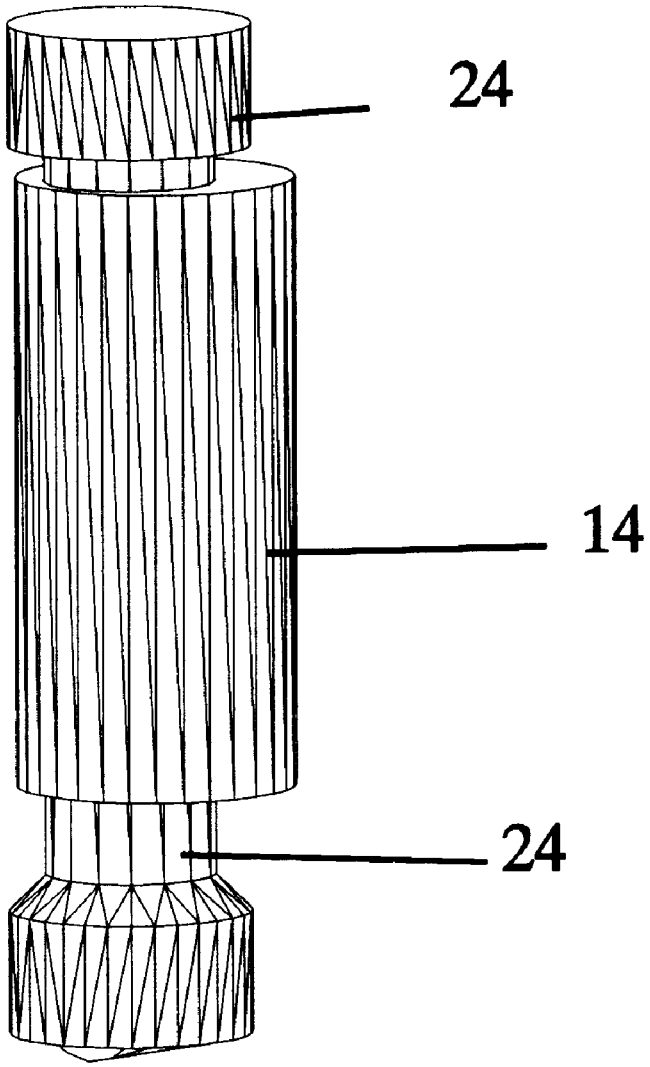
FIG. 11 shows a necked-down follower with a matching eccentric sleeve. The sleeve shows no drive mechanism.

FIG. 11 shows a sleeve 14 with a smaller diameter for the offset hole. The follower 24 has a smaller diameter for the section that slides inside sleeve 14. Either the upper section of 24, where the pushrod or rocker arm would seat, or the lower section near the roller would be separable from the remainder of follower 24 to enable fitment of the follower inside sleeve 14.

Figure 12:
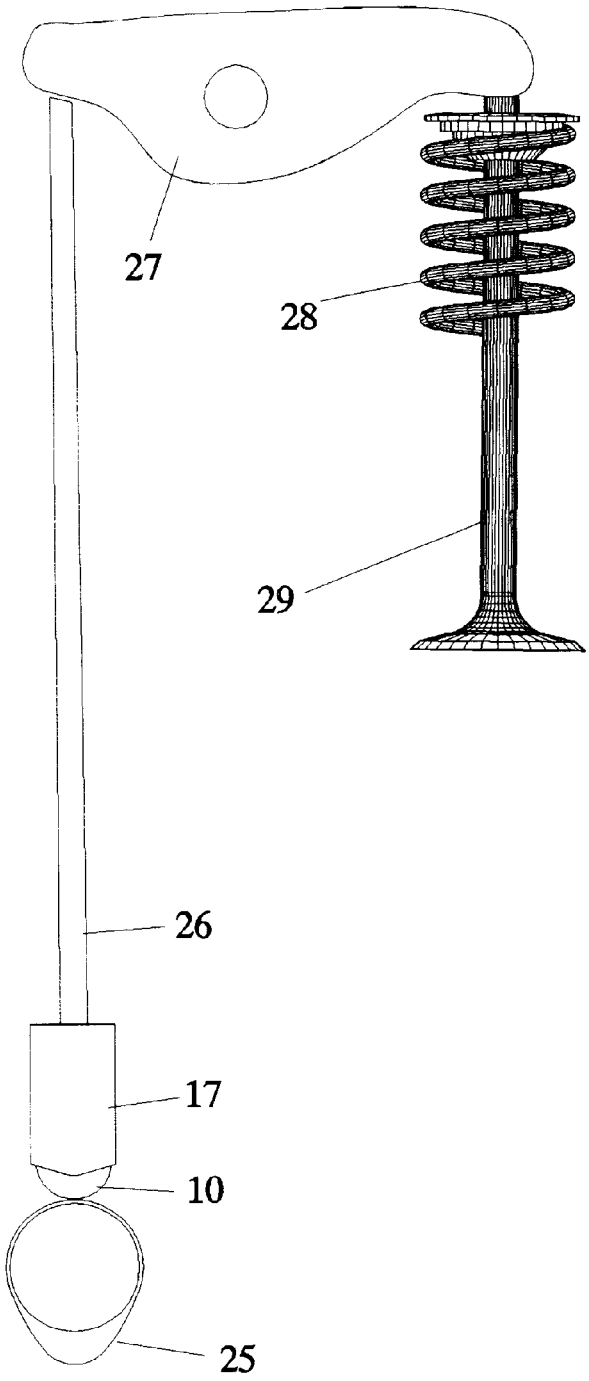
FIG. 12 (Prior art)
FIG. 12 shows a conventional arrangement of cam, roller follower, push rod, rocker arm and valve with return spring, as used in an internal combustion engine.

FIG. 12 shows a rotatable cam 25 that actuates the roller 10 of follower 17 to move the follower 17 parallel to its axis, acting on push rod 26 to cause rocker arm 27 to partially rotate, forcing valve 29 to open. Spring 28 causes valve 29 to return to its starting position after rotation of cam 25 causes valve 29 to move from rest to its position of greatest movement.

What is claimed is:

1. An apparatus in an internal combustion engine having a set of timed valves activated by cam followers engaged with a camshaft, the apparatus comprising: a cam follower mounted in an element rotatable within a hole in the engine; said cam follower having a curved surface engageable with the camshaft at an engagement surface; whereby rotation of the rotatable element within the hole shifts the engagement surface to thereby alter the valve timing while maintaining valve duration substantially constant.

2. The apparatus of claim 1, wherein the axis of the cam follower is eccentric from an axis of rotation of the rotatable element within the hole.

3. The apparatus of claim 1, further comprising a rotator engaged with said rotatable element to rotate the rotatable element and thereby alter the valve timing while maintaining valve duration substantially constant.

4. The apparatus of claim 3, wherein said rotator includes a rod moveable in a direction substantially tangential to an axis of rotation of the rotatable element and a tang having one end attached to the rotatable element and an opposite end attached to the rod.

5. An apparatus in an internal combustion engine having a set of timed valves activated by cam followers engaged with a camshaft, the apparatus comprising: a cam follower mounted in each one of a plurality of elements rotatable within a plurality of holes in the engine; each said cam follower having a curved surface engageable with the camshaft at an engagement surface; whereby rotation of the rotatable elements within the holes shifts the engagement surfaces to thereby alter the valve timing while maintaining valve duration substantially constant.

6. The apparatus of claim 5, wherein the axis of each cam follower is eccentric from the axis of rotation of the rotatable element within its corresponding hole.

7. The apparatus of claim 5 further comprising a rotator engaged with the rotatable elements to rotate the rotatable elements and thereby alter the valve timing.

8. The apparatus of claim 7, wherein said rotator includes at least one rod moveable in a direction substantially tangential to an axis of rotations of a rotatable element, and a separate tang for each rotatable element, each tang having one end attached to a rotatable element and an opposite end engaged with said rod.

9. The apparatus of claim 8, wherein said rotator includes a separate rod for each rotatable element moveable in a direction substantially tangential to an axis of rotation of such rotatable element, each tang having one end attached to a rotatable element and an opposite end engaged with the rod for such rotatable element.

10. The apparatus of claim 8, wherein said rotator includes a rod for a plurality of rotatable elements that are rotatable in substantially parallel axes, the rod being moveable in a direction substantially tangential to said axes, and a separate tang for each of said plurality of rotatable elements, each tang having one end attached to the rotatable element for said tang and an opposite end engaged with said rod.

11. The apparatus of claim 9, wherein said tangs and rod are engaged by pins and slots.

12. The apparatus of claim 7, wherein said rotators include a worm drive.

13. A method of altering the timing of timed valves in an internal combustion engine activated by cam followers mounted in elements rotatable with the engine, the cam followers being engaged with a camshaft at an engagement surface, comprising: rotating the rotatable elements to shift said engagement surface to thereby alter the valve timing while maintaining valve duration substantially constant.

14. The method of claim 13, wherein an axis of rotation of the cam follower is eccentric from an axis of rotation of the rotatable element.

* * * * *